US006344822B1

(12) United States Patent
Watts, Jr. et al.

(10) Patent No.: US 6,344,822 B1
(45) Date of Patent: Feb. 5, 2002

(54) INSTRUMENT LANDING GLIDE SLOPE

(75) Inventors: Chester B. Watts, Jr., Annandale; John Henry Johnson, Leesburg, both of VA (US)

(73) Assignee: Watts Antenna CO, Herndon, VA (US)

( * ) Notice: Subject to any disclaimer, the term of this patent is extended or adjusted under 35 U.S.C. 154(b) by 0 days.

(21) Appl. No.: 09/233,746

(22) Filed: Jan. 20, 1999

(51) Int. Cl.[7] ..... H01Q 13/10; H01Q 1/14
(52) U.S. Cl. ..... 343/269; 343/878; 343/886
(58) Field of Search ..... 343/769, 878, 343/770, 771, 886, 853; H01Q 13/10, 1/14

(56) References Cited

U.S. PATENT DOCUMENTS 1,747,008 A * 2/1930 Jacobson ..... 343/886
4,464,665 A * 8/1984 Watts ..... 343/771

* cited by examiner

*Primary Examiner*—Michael C. Wimer

(57) ABSTRACT

This invention provides an improvement in Glide Slope antenna systems of the earth-image type. The standard antenna usually is mounted on a steel tower located several hundred feet to one side of the runway, considered a safe distance to avoid being struck by an airplane. This invention, however, employs an antenna system using wide aperture slotted cable elements. Frangible construction permits it to be located safely much closer to the runway. The closer spacing, with the wide aperture, provides for a vertical guidance pattern that is narrower in azimuth, resulting in improved quality of guidance. An additional slotted cable, fed only with clearance signal, provides fly-up indication, both sides, over a wider azimuth sector.

2 Claims, 2 Drawing Sheets

INSTRUMENT LANDING GLIDE SLOPE

CROSS-REFERENCE TO RELATED APPLICATIONS

"Not applicable"

STATEMENT REGARDING FEDERALLY SPONSORED RESEARCH OR DEVELOPMENT

"Not applicable"

REFERENCE TO A MICROFICHE APPENDIX

"Not applicable"

BACKGROUND OF THE INVENTION

This invention relates to an improvement in the Instrument Landing System (ILS) for aircraft, in particular, the glide slope component thereof, employing an antenna system of the earth-image type, such as described in Butts, H. H., U.S. Pat. No. 3,325,812, Jun. 13, 1967, Capture Effect Glide Slope System, (Ref.1).

The standard antenna usually is mounted on a steel tower located several hundred feet to one side of the runway, considered a safe distance to avoid being struck by an airplane. This invention, however, is an antenna using wide aperture slotted cable elements, such as described in U.S. Pat. No. 4,464,665, Aug. 7, 1984, Watts, Jr., (Ref.2), or in co-pending application "Improvement in Slotted Cable Antenna Structure." Frangible construction permits it to be located safely much closer to the runway. These characteristics allow for a guidance radiation pattern having narrow azimuthal coverage, resulting in improved glide slope performance in the vertical plane, together with fly-up signal to both sides as well as below path.

BRIEF SUMMARY OF THE INVENTION

The invention is an improvement on standard ILS image-type glide slope antenna arrays. It replaces the usual antenna elements with wide aperture slotted cables. Mounted on a frangible support, the antenna array can be located safely much closer to the runway. The closer spacing, with the wide aperture, provides for a vertical guidance pattern that is narrower in azimuth, resulting in improved quality of guidance. An additional slotted cable, fed only with clearance signal, provides fly-up indication, both sides, over a wider azimuth sector.

DETAILED DESCRIPTION OF THE INVENTION

Figure 1:
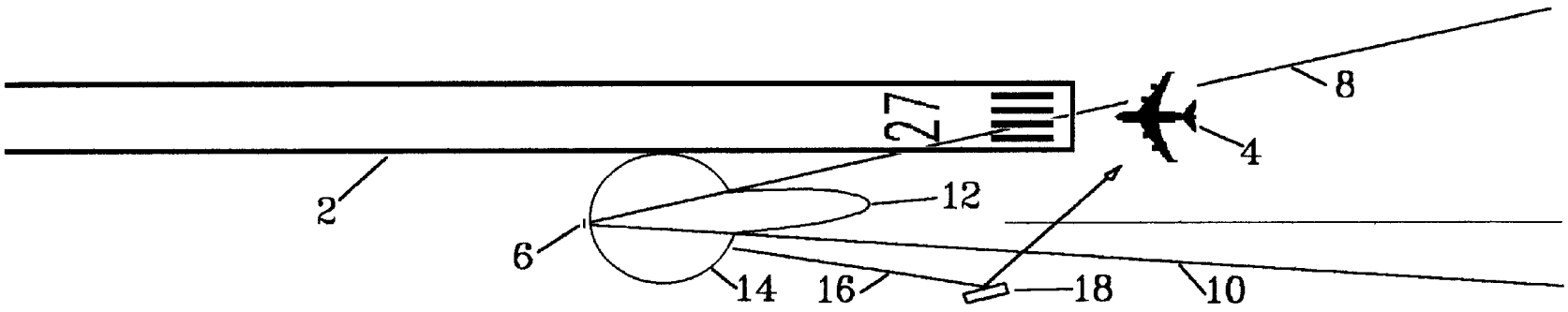
FIG. 1 is a plan view of a runway showing the narrow guidance sector and the wider clearance sector provided.

A plan view of a portion of runway 2 with approaching airplane 4 is shown in FIG. 1., relative to the glide slope antenna location 6. Radial line 8 and radial line 10 define the azimuth sector containing vertical guidance pattern 12, radiating on rf frequency F1. In order to minimize multi-path distortion, pattern 12 is preferred to be no wider than necessary. A narrow azimuth pattern 12 also tends to confine the Fresnel zone of reflection to an area close to the runway where the surface is apt to be more flat. Clearance fly-up signal is radiated in a broad azimuth pattern 14, on rf frequency F2, slightly displaced from F1. Ray 16, containing F2 clearance signal reflects from building 18, into the path of airplane 4 where it combines with guidance signal F1. However, the well known capture effect increases the discrimination ratio, favoring the stronger F1 guidance by twice the rf ratio squared, more or less, depending somewhat on the detection characteristic of the particular receiver.

Figure 2:
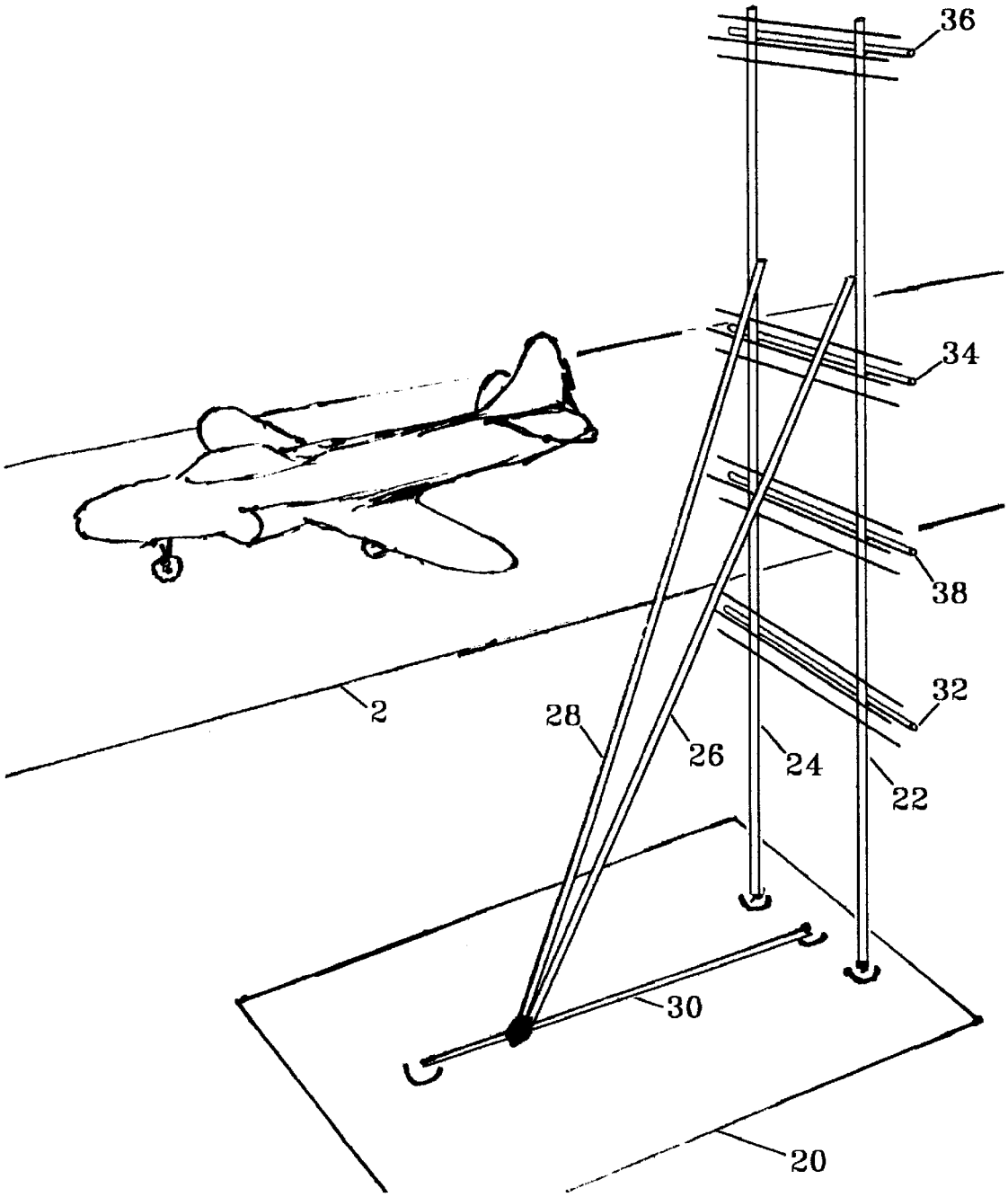
FIG. 2 is a sketch of one embodiment of the antenna structure in relation to a runway.

FIG. 2 represents an embodiment of the invention shown beside a runway 2. It is a frangible structure, defined here as one through which an airplane can pass without causing serious injury to the occupants. The structure is mounted on a concrete pad 20. It has two uprights, thin wall glass fiber tube 22 and tube 24. Diagonal bracing of similar material in provided by tube 26 and tube 28 anchored to the metal gin pole 30, used for raising and lowering the structure. The slotted cable capture effect antennas, with reflectors, radiating glide slope precision guidance signals, on a frequency F1, are lower 32, middle 34, and upper 36. An additional slotted cable antenna 38, with reflector, has a wider azimuth pattern, radiating only clearance frequency F2, providing positive fly-up indication on both sides of the sharper guidance sector.

We claim:

1. An improved instrument landing glide slope antenna system comprising a frangible structure in proximity to a runway, said structure supporting a number of antenna elements, disposed vertically, each of said elements being fed signals on a first radio frequency, whereby said antenna elements collectively radiate vertical guidance within a certain azimuth sector, with an additional antenna element or elements being fed a second radio frequency signal, whereby said second radio frequency radiates fly-up command in additional azimuth sector or sectors.

2. A system as in claim 1 wherein each of said elements comprises a coaxial transmission line with radiating slot assemblies.

* * * * *